US006739584B2

(12) United States Patent
Fujino et al.

(10) Patent No.: US 6,739,584 B2
(45) Date of Patent: May 25, 2004

(54) FLOAT APPARATUS OF CARBURETOR

(75) Inventors: Yuki Fujino, Kakuda (JP); Akira Akabane, Kakuda (JP)

(73) Assignee: Keihin Corporation, Tokyo (JP)

( * ) Notice: Subject to any disclaimer, the term of this patent is extended or adjusted under 35 U.S.C. 154(b) by 116 days.

(21) Appl. No.: 10/205,576

(22) Filed: Jul. 24, 2002

(65) Prior Publication Data

US 2003/0030156 A1 Feb. 13, 2003

(30) Foreign Application Priority Data

Jul. 26, 2001 (JP) ..... 2001-225335

(51) Int. Cl.[7] ..... F02M 5/16
(52) U.S. Cl. ..... 261/70; 137/423; 137/434
(58) Field of Search ..... 261/70; 137/423, 137/434

(56) References Cited

U.S. PATENT DOCUMENTS

| | | | | | |
|---|---|---|---|---|---|
| 1,066,151 | A | * | 7/1913 | Rice | 137/39 |
| 2,914,307 | A | * | 11/1959 | Eickmann | 261/134.2 |
| 3,284,066 | A | * | 11/1966 | Biver | 261/70 |
| 3,985,836 | A | * | 10/1976 | Fischer | 261/39.2 |
| 4,034,026 | A | * | 7/1977 | Miller | 261/23.2 |
| 4,513,725 | A | * | 4/1985 | Minami et al. | 123/511 |
| 5,385,697 | A | * | 1/1995 | Jenson | 261/70 |
| 5,916,489 | A | * | 6/1999 | Takeuchi | 261/70 |

FOREIGN PATENT DOCUMENTS

| | | | | |
|---|---|---|---|---|
| JP | 56-83555 | * | 7/1981 | 261/70 |
| JP | 1-271648 | * | 10/1989 | 261/70 |
| JP | 4-128542 | * | 4/1992 | 261/70 |

* cited by examiner

*Primary Examiner*—Richard L. Chiesa
(74) *Attorney, Agent, or Firm*—ZITO tlp; Joseph J. Zito; Kendal M. Sheets

(57) ABSTRACT

To prevent a fuel liquid surface within a float chamber from rising when a liquid surface change occurs to make a float rotate so that a float valve opens a valve seat hole, a first float (F3) is arranged in one outer side from one end (F4) of the bearing portion (F1) and in one side (B), one end (F4) of the bearing portion (F1) and the first float (F3) are connected by a first connecting arm portion (F6), a second float (F7) is arranged in another outer side from another end (F8) of the bearing portion (F1) and in one side (B), another end (F8) of the bearing portion (F1) and the second float (F7) are connected by a second connecting arm portion (F19), a first buffer rib (F12) is integrally formed between an outer side surface (F6A) of the first connecting arm portion (F6) and another side surface (F5) of the first float (F5), and a second buffer rib (F13) is integrally formed between an outer side surface (FIOA) of the second connecting arm portion (F10) and another side surface (F9) of the second float (F7).

1 Claim, 4 Drawing Sheets

PRIOR ART

FLOAT APPARATUS OF CARBURETOR

BACKGROUND OF THE INVENTION

1. Field of the Invention

The present invention relates to a carburetor which controls a concentration and an amount of an air-fuel mixture supplied to an engine, and more particularly to a float forming and maintaining a fixed fuel liquid surface within a float chamber of the carburetor in association with a valve seat and a float valve controlling to open and close the valve seat.

2. Description of Conventional Art

A description will be given of a conventional float apparatus of a carburetor with reference to FIGS. 4 and 5.

FIG. 4 is a vertical cross sectional view of a main portion of a carburetor, and FIG. 5 is a horizontal cross sectional view in a line A—A in FIG. 4. Reference numeral 1 denotes a carburetor main body within which an intake passage 2 extends through in a side direction. A float chamber 4 is formed by a lower recess portion 1A of the carburetor main body 1 facing downward, and a cup-shaped float chamber main body 3 arranged so as to face thereto.

Reference numeral 5 denotes a valve seat attached to a valve seat boss 1C of the carburetor main body 1 and arranged so as to face to the inside of the float chamber 4. A valve seat hole 5A formed in the valve seat 5 is opened and closed by a float valve 6 movably arranged within the valve seat 5.

A fuel inflow passage 7 connected to a fuel source (not shown) is open to an upper portion of the valve seat 5, and a lower end of the float valve protrudes toward an inner portion of the float chamber 4.

Reference numeral 9 denotes a float corresponding to a fixed liquid surface control apparatus for forming a fixed liquid surface X—X within the float chamber 4 in association with the valve seat 5 and the float valve 6. The float 9 is constituted by the following elements.

Reference symbol 9A denotes a cylindrical bearing portion in which a support hole 9B is pierced so as to extend through in an axial direction, and reference symbol 9C denotes a first float arranged further in one outer side G1 from one end 9D of the bearing portion 9A and apart from the bearing portion 9A in a direction of one side B.

In the present embodiment, one side B means a right side in the drawing.

Further, a portion near one end 9D of the bearing portion 9A and another side surface 9F of the first float 9C are connected by a first connecting arm portion 9G.

Reference symbol 9H denotes a second float arranged further in another outer side G2 from another end 9J of the bearing portion 9A and apart from the bearing portion 9A in a direction of one side B. A portion near another end 9J of the bearing portion 9A and another side surface 9K of the second float 9H are connected by a second connecting arm portion 9L.

In accordance with the structure mentioned above, the first float 9C and the second float 9H are arranged in the respective outer sides G1 and G2 of one end 9D and another end 9J of the bearing portion 9A and apart from the bearing portion 9A in the direction of one side B, and an inner side surface 9M of the first float 9C and an inner side surface 9N of the second float 9H are arranged with a gap S.

Further, reference symbol 9P denotes a flat tongue portion extending from a center portion of the bearing portion 9A toward one side B in a horizontal direction.

Further, the bearing portion 9A of the float is rotatably supported to a pair of shaft portions 1B stood toward an inner portion of the float chamber 4 from the carburetor main body 1 via an arm pin 10, and at this time, an upper surface of the tongue portion 9P is arranged so as to face to the lower end of the float valve 6.

In this case, reference numeral 11 denotes a throttle valve for opening and closing the intake passage 2, reference numeral 12 denotes a main fuel boss arranging a main fuel system constituted by a needle jet 13 open to the intake passage 2 and the like, and reference numeral 14 denotes a low speed fuel boss arranging a low speed fuel system toward a bypass hole 15 open within the intake passage 2 in correspondence to the throttle valve 11. These bosses 12 and 14 are provided in a standing manner toward the inner portion of the float chamber 4 from the carburetor main body 1.

Further, reference numeral 16 denotes a negative pressure response valve variably controlling an open area of the intake passage 2 on the basis of a negative pressure generated within the intake passage 2. A jet needle 17 integrally attached to the negative pressure response valve 16 is inserted and arranged within the needle jet 13.

In this case, a fixed fuel liquid surface X—X is formed within the float chamber 4 due to a cooperative effect of the valve seat, the float valve 6 and the float 9 in the following manner.

In a state that the inner portion of the float chamber 4 is empty, the float 9 rotates in a clockwise direction on the basis of an arm pin 10, and the tongue portion 9P also rotates in a clockwise direction, whereby the float valve 6 moves in a downward direction so as to open the valve seat hole 5A.

In accordance with the structure mentioned above, the fuel existing in the fuel inflow passage 7 flows into the float chamber 4 via the valve seat hole 5A, gradually stores the fuel within the float chamber 4 and gradually raises the fuel liquid surface. Due to the rise of the fuel liquid surface, the float 9 rotates in a counterclockwise direction on the basis of the arm pin 10, and as soon as a fixed fuel liquid surface (hereinafter, refer to a fixed liquid surface X—X) is formed within the float chamber, the tongue portion 9P upward moves the float valve 6 so as to close the valve seal hole 5A, whereby the fixed liquid surface X—X is formed within the float chamber 4.

Thereafter, when the fuel liquid surface within the float chamber 4 is lowered with respect to the fixed liquid surface X—X, the float valve 6 opens the valve seat hole 5A on the basis of a rotation of the float 9 in a clockwise direction so as to supply the fuel toward the inner portion of the float chamber 4 from the fuel inflow passage 7, and as soon as the fixed liquid surface X—X is formed, the float valve 6 closes the valve seat hole 5A on the basis of a rotation of the float 9 in a counterclockwise direction, the fuel supply from the valve seat hole 5A into the float chamber 4 is stopped, and these operations are repeated, whereby the fixed liquid surface X—X is always formed within the float chamber 4.

In accordance with the conventional float apparatus of the carburetor mentioned above, when the fuel liquid surface X—X within the float chamber 4 changes to a right inclined state, it is hard to properly control the fuel liquid surface. (The right inclined state means a right downward state as shown by a single-dot chain line in FIG. 4). This is caused by the following reasons.

The first and second float 9C and 9H are arranged to one side B apart from the bearing portion 9A. This arrangement is performed for the purpose of placing a center of buoyancy of the float 9 to one side B as apart as possible from a center in a longitudinal direction of the support hole 9B of the bearing portion 9A so as to increase a blocking force with respect to the float valve 6. When the bearing portion 9A of the float 9 mentioned above is attached to the shaft portion 1B of the carburetor main body 1 via the arm pin 10, a comparatively large space K is formed between another side surfaces 9F and 9K of the respective float 9C and 9H and another side wall 3A of the float chamber main body 3.

This space K is expressed by a cross line in FIG. 5.

In the carburetor using the float 9, the fixed liquid surface X—X in the horizontal direction is shown in FIG. 4, and in this state, the float valve 6 is pressed to the valve seat hole 5A of the valve seat 5 by the tongue portion 9P of the float 9, and closes and holds the valve seat hole 5A, whereby the fixed liquid surface X—X in the horizontal direction is formed and held.

In the state mentioned above, when a motor cycle or the like travels on a rough road, is rapidly accelerated or the like, there is a case that the fixed liquid surface X—X within the float chamber 4 largely changes to a right inclined state XI—XI, and at this time, the fuel within the float chamber 4 flows upward at a high speed via the space K formed between another side surfaces 9F and 9K of the float 9 and another side wall 3A of the float chamber main body 3. Further, due to the fast fuel inflow, the float 9 rotates in a clockwise direction around the arm pin 10 corresponding to a supporting point, whereby the float valve 6 opens the valve seat hole 5A of the valve seat 5, and a lot of fuel flows into the float chamber 4 via the fuel inflow passage 7 so as to largely raise the fuel liquid surface within the float chamber 4. (Incidentally, in the case that the fuel liquid surface changes to a left inclined state, the float 9 rotates in a counterclockwise direction, so that, since the float valve 6 exists in a side of closing the valve seat hole SA of the valve seat 5, the fuel liquid surface within the float chamber 4 does not rise.)

Further, due to the rise of the fuel liquid surface X1—X1 in the rightward inclined state mentioned above, there is a case that the concentration of the air-fuel mixture tends to be rich or the fuel leaks to an external portion via an overflow pipe.

SUMMARY OF THE INVENTION

A float apparatus of a carburetor in accordance with the present invention is made by taking the problems mentioned above into consideration, and a first object of the present invention is to provide a float apparatus which can restrict a fuel quick inflow within a float chamber by a float when a liquid surface change occurs so that a float rotates to a side in which a float valve opens a valve seat hole of a valve seat, thereby preventing a fuel liquid surface formed within the float chamber from being raised.

Further, a second object of the present invention is to prevent the fuel liquid surface from being raised, by restricting a fast swing of the float due to an external reason.

In order to achieve the object mentioned above, in accordance with a first aspect of the present invention, there is provided with a float apparatus of a carburetor comprising:

a carburetor main body within which an intake passage is provided to extend in a side direction;

a float chamber main body arranged below the carburetor main body and forming a float chamber together with a lower recess portion of the carburetor main body; and a float rotatably supported to a shaft portion stood from the carburetor main body via an arm pin, and opening and closing a float valve for opening and closing a valve seat open within the float chamber in correspondence to a change of a liquid surface formed within the float chamber, wherein the float comprises:

a bearing portion rotatably supported to the shaft portion via the arm pin;

a tongue portion extending to one side from a center of the bearing portion;

a first float arranged in one outer side from one end of the bearing portion and in one side;

a first connecting arm portion connecting one end of the bearing portion to the first float;

a second float arranged in another outer side from another end of the bearing portion and in one side B; and a second connecting arm portion connecting another end of the bearing portion to the second float, wherein a flat first buffer rib substantially in parallel to a fuel liquid surface X—X is integrally formed between an outer side surface of the first connecting arm portion and another side surface of the first float, and a flat second buffer rib substantially in parallel to the fuel liquid surface is integrally formed between an outer side surface of the second connecting arm portion and another side surface of the second float.

Further, in accordance with a second aspect of the present invention, there is provided a float apparatus of a carburetor as recited in the first aspect, wherein bottom surfaces of the first float and the second float are formed in a flat shape substantially in parallel to the fuel liquid surface, and third buffer ribs extending inward are respectively provided on the bottom surfaces of the respective floats.

In accordance with the first aspect of the present invention, when the fuel liquid surface within the float chamber is changed to the side in which the float valve opens the valve seat hole of the valve seat, the flow of the fuel flowing into upward via an interior portion of the chamber is exposed to a resistance of the first and second buffer ribs, can gradually rotate the float in the clockwise direction, can restrict the liquid surface rise formed within the float chamber, and can prevent the mixture from being made too rich and prevent the fuel from being leaked to the external portion.

Further, in accordance with the second aspect of the present invention, in addition to the first effect, since the bottom surfaces of the first and second floats are formed in the flat shape and the third buffer rib operates in a synergistic manner, it is possible to restrict a vibration of the float due to the external vibration, and it is possible to further stabilize the fuel liquid surface.

DESCRIPTION OF THE PREFERRED EMBODIMENT

A description will be given below of one embodiment of a float apparatus of a carburetor in accordance with the present invention with reference to FIGS. 1 and 2.

Figure 1:
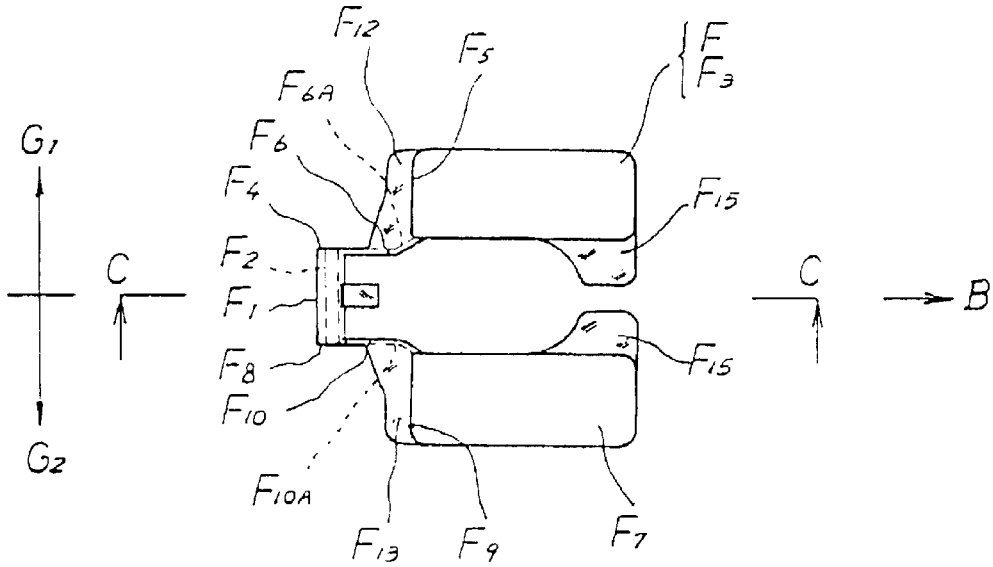
FIG. 1 is a plan view of an upper portion of a float apparatus in accordance with the present invention.
Figure 2:
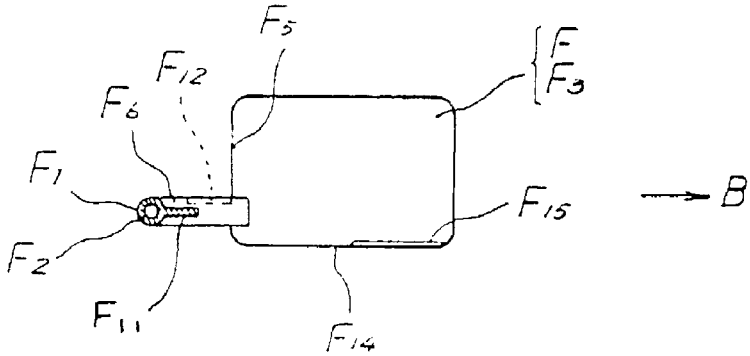
FIG. 2 is a vertical cross sectional view along a line C—C in FIG. 1.

FIG. 1 is a plan view of an upper portion of a float, and FIG. 2 is a vertical cross sectional view along a line C—C in FIG. 1.

A float F is constituted by the following elements.

Reference symbol F1 denotes a cylindrical bearing portion in which a support hole F2 is pierced so as to extend through in an axial direction, and reference symbol F3 denotes a first float arranged further in one outer side G1 from one end F4 of the bearing portion F1 and apart from the bearing portion F3 in a direction of one side B.

Further, a portion near one end F4 of the bearing portion F1 and another side surface F5 of the first float F3 are connected by a first connecting arm portion F6.

Reference symbol F7 denotes a second float arranged further in another outer side G2 from another end F8 of the bearing portion F1 and apart from the bearing portion F1 in a direction of one side B.

Further, a portion near another end F8 of the bearing portion F1 and another side surface F9 of the second float F7 are connected by a second connecting arm portion F10.

In this case, reference symbol F11 denotes a flat tongue portion extending from a center portion of the bearing portion F1 toward one side B in a horizontal direction.

In this case, in accordance with the present invention, the following buffer ribs are particularly provided.

That is, a first buffer rib F12 is formed as a flat plate portion parallel to the fuel liquid surface X—X between an outer side surface F6A of the first connecting arm portion F6 and another side surface F5 of the first float F3.

In other words, this first buffer rib F12 is formed so as to correspond to the space K formed among the outer side surface of the first connecting arm portion 9G, another side surface 9F of the first float 9C and another side wall 3A of the float chamber main body 3 in the conventional float 9.

A second buffer rib F13 is formed as a flat plate portion parallel to the fuel liquid surface X—X between an outer side surface F10A of the second connecting arm portion F10 and another side surface F9 of the second float F7.

In other words, this second buffer rib F13 is formed so as to correspond to the space K formed among the outer side surface of the second connecting arm portion 9L, another side surface 9K of the second float 9H and another side wall 3A of the float chamber main body 3 in the conventional float 9.

Further, the float F mentioned above is arranged within the float chamber 4 in the same manner as that of the conventional structure, the arm pin 10 is inserted into the support hole F2 of the bearing portion F1, and both ends of the arm pin 10 are rotatably supported and arranged in the shaft portion 1B stood from the carburetor main body 1.

Figure 3:
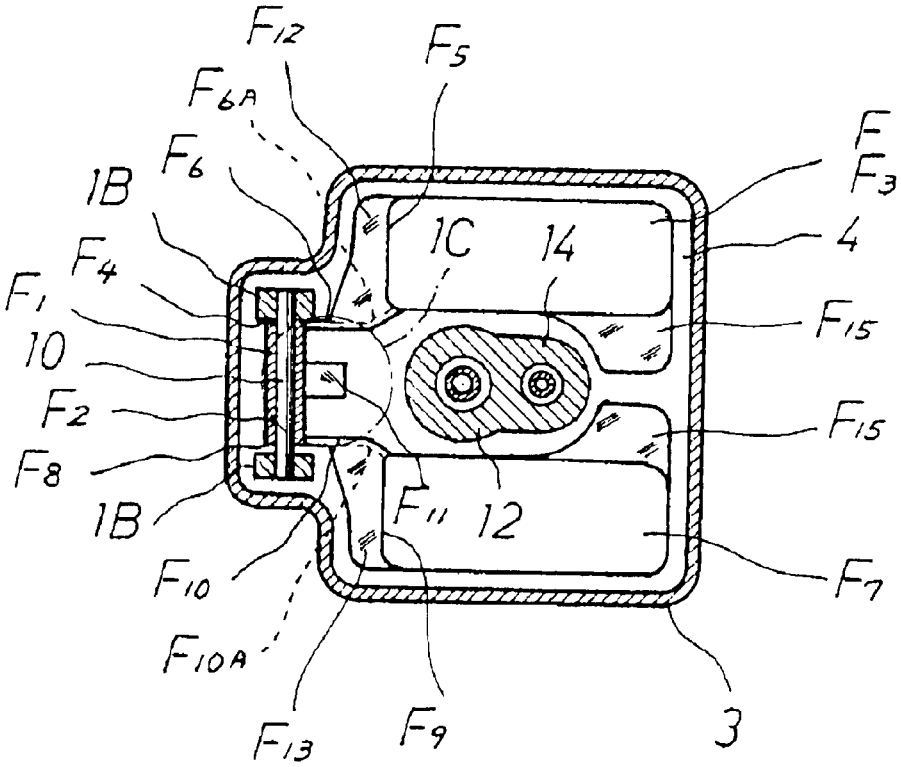
FIG. 3 is a horizontal cross sectional view in a state of arranging the float apparatus in accordance with the present invention within a float chamber.

This state is shown in FIG. 3.

As is understood from the description mentioned above, the space K formed among the outer side surface of the first connecting arm portion 9G, another side surface 9F of the first float 9C and another side wall 3A of the float chamber main body 3 in the conventional structure, is largely blocked by the first buffer rib F12. Further, the space K formed among the outer side surface of the second connecting arm portion 9L another side surface 9K of the second float 9H and another side wall 3A of the float chamber main body 3 in the conventional art, is largely blocked by the second buffer rib 13.

Figure 4:
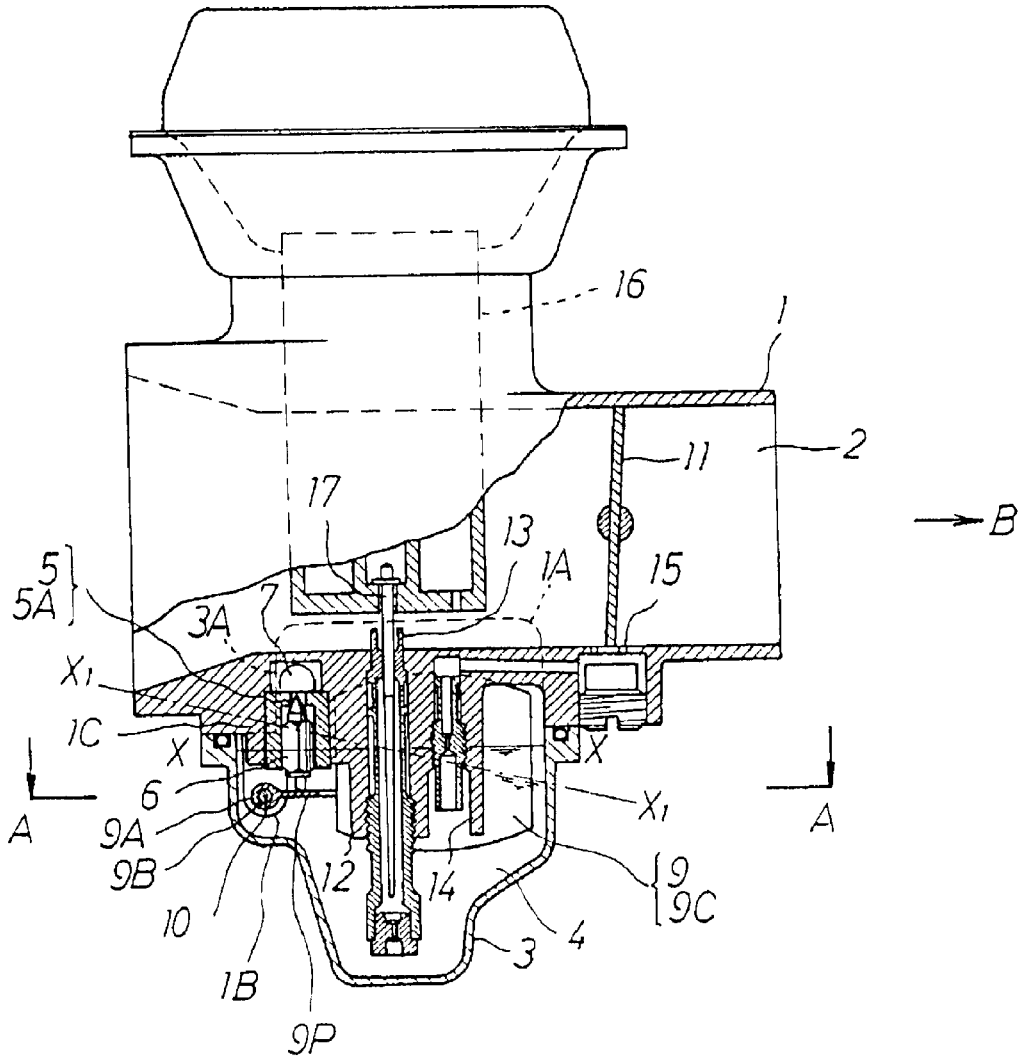
FIG. 4 is a vertical cross sectional view of a carburetor using a conventional float apparatus.
Figure 5:
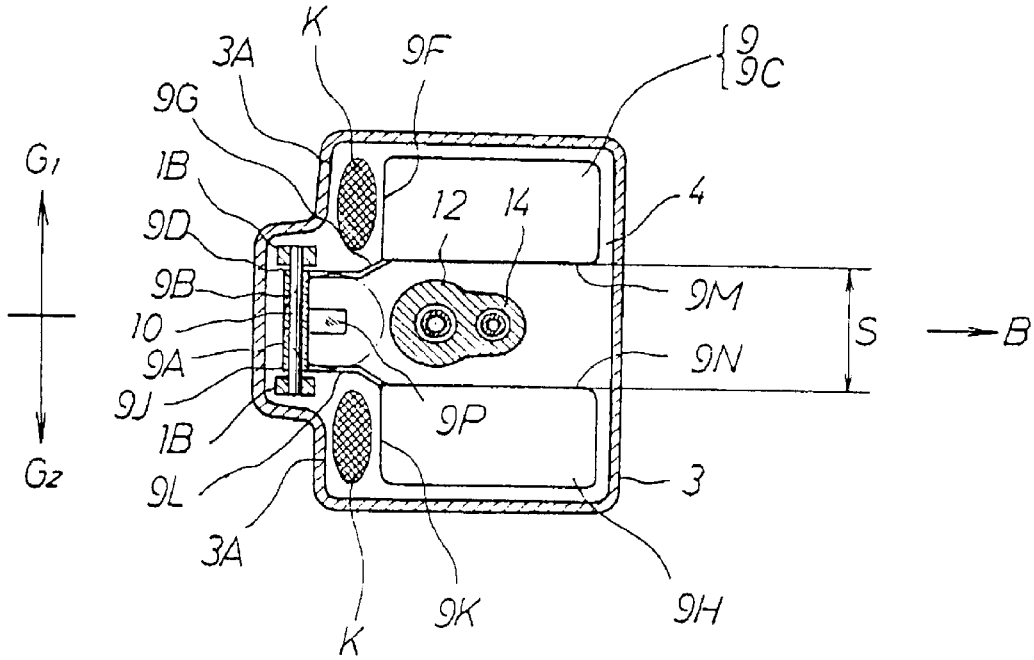
FIG. 5 is a horizontal cross sectional view along a line A—A in FIG. 4.

Accordingly, in FIG. 4, when the fuel liquid surface X—X in the horizontal direction formed within the float chamber 4 moves to the fuel liquid surface X—X in the right inclined state, the fuel flow flowing upward in the space K is exposed to a resistance applied by the first buffer rib F12 and the second buffer rib F13, whereby the rotation in the clockwise direction of the float F can be gradually performed.

Accordingly, since the float valve 6 neither opens the valve seat hole 5A of the valve seat 5 in a breath nor continuously opens, it is possible to restrict the liquid surface rise within the float chamber 3, it is possible to prevent the concentration of the mixture from being made rich due to the liquid surface increase, and it is possible to effectively prevent the fuel from leaking out via an overflow pipe.

In this case, in the gap formed around the tongue portion F11, the fuel flowing upward is prevented by the lower surface of the valve seat boss 1C including the valve seat 5 from flowing upward.

Further, a second feature of the float in accordance with the present invention is that the following structure is added to the float F mentioned above.

Firstly, a bottom surface F14 of the first float F3 and the second float F7 is formed in a flat shape, and secondly, a flat third buffer rib F15 is provided along the fuel liquid surface X—X inward from the bottom surfaces F14 of the respective floats F3 and F7.

In accordance with the structure mentioned above, in the case that the float F vibrates due to the external reason at a time when the motor cycle or the like travels on a rough road, the movement of the float F is reduced.

That is, in the case that the bottom surface F14 of the float F existing below the fixed liquid surface X—X is going to move downward, the flat-shaped bottom surface F14 applied the great resistance to the downward movement of the float F, thereby restricting the vibration of the float F in the downward direction.

Further, since the third buffer rib F 15 exists below the fixed liquid surface X—X, the third buffer rib F15 applies the great resistance to the movement of the float F in the vertical direction, thereby restricting the vibration of the float F in the vertical direction.

Accordingly, the first buffer rib F12, the second buffer rib F13, the third buffer rib F15 and the flat shape of the bottom surfaces F14 in the first and second floats F3 and F7 provided in the float F are applied in a synergetic manner, whereby it is possible to further accurately form and hold the fuel liquid surface.

As mentioned above, in accordance with the first aspect of the float apparatus of the carburetor of the present invention, since the float is constituted by the bearing portion rotatably supported to the shaft portion via the arm pin, the tongue portion extending to one side from the center of the bearing portion, the first float arranged in one outer side from one end of the bearing portion and in one side, the first connecting arm portion connecting one end of the bearing portion to the first float, the second float arranged in another outer side from another end of the bearing portion and in one side B, and the second connecting arm portion connecting another end of the bearing portion to the second float, the flat first buffer rib substantially in parallel to the fuel liquid surface X—X is integrally formed between the outer side surface of the first connecting arm portion and another side surface of the first float, and the flat second buffer rib substantially in parallel to the fuel liquid surface is integrally formed between the outer side surface of the second connecting arm portion and another side surface of the second float, it is possible to restrict the changing speed of the fuel liquid surface to be gradual by the first and second buffer ribs provided in the float when the fuel liquid surface within the float chamber is changed to the side in which the float valve opens the valve seat hole of the valve seat, whereby it is possible to effectively restrict the rise of the fuel liquid surface within the float chamber. Accordingly, it is possible to prevent the mixture from being made too rich and prevent the fuel from leaking outward.

Further, in the case that the bottom surfaces of the first float and the second float are formed in the flat shape substantially in parallel to the fixed liquid surface, and the third buffer ribs extending inward are respectively provided on the bottom surfaces, in addition to the first and second buffer ribs, since the float itself has a damping function with respect to the vibration applied to the float due to the external reason, in addition to the effects mentioned above, it is possible to stabilize the fuel liquid surface, it is possible to achieve a proper mixture concentration, and it is possible to more effectively prevent the fuel from leaking outward.

What is claimed is:

1. A float apparatus of a carburetor comprising:

a carburetor main body within which an intake passage is provided to extend in a side direction;

a float chamber main body arranged below the carburetor main body and forming a float chamber together with a lower recess portion of the carburetor main body; and a float rotatably supported to a shaft portion stood from the carburetor main body via an arm pin, and opening and closing a float valve for opening and closing a valve seat open within the float chamber in correspondence to a change of a liquid surface formed within the float chamber, wherein the float comprises:

a bearing portion rotatably supported to the shaft portion provided in the carburetor main body in a standing manner via the arm pin;

a tongue portion extending to one side from a center of the bearing portion;

a first float arranged in one outer side from one end of the bearing portion and in one side of said float chamber;

a first connecting arm portion connecting one end of the bearing portion to the first float;

a second float arranged in another outer side from another end of the bearing portion and in said one side of said float chamber; and a second connecting arm portion connecting another end of the bearing portion (F1) to the second float, wherein a flat first buffer rib substantially in parallel to a fuel liquid surface is integrally formed between an outer side surface of the first connecting arm portion and another side surf ace of the first float, and a flat second buffer rib substantially in parallel to the fuel liquid surface is integrally formed between an outer side surface of the second connecting arm portion and another side surface of the second float, wherein bottom surfaces of the first float and the second float are formed in a flat shape substantially in parallel to the fuel liquid surface, and third buffer ribs extending inward are respectively provided on the bottom surfaces of the first float and the second float.

* * * * *